US006585555B2

(12) United States Patent
Wong et al.

(10) Patent No.: US 6,585,555 B2
(45) Date of Patent: Jul. 1, 2003

(54) TEMPERATURE SENSITIVE COLOR CHANGING WATER TOY

(75) Inventors: Veronica P. C. Wong, Hong Kong (HK); Francis S. C. Chia, Hong Kong (HK)

(73) Assignee: Prime Time Toys, Ltd., Twun Tong (HK)

( * ) Notice: Subject to any disclaimer, the term of this patent is extended or adjusted under 35 U.S.C. 154(b) by 0 days.

(21) Appl. No.: 10/001,726

(22) Filed: Oct. 18, 2001

(65) Prior Publication Data

US 2003/0077976 A1 Apr. 24, 2003

(51) Int. Cl.[7] ..... A63H 23/00

(52) U.S. Cl. ..... 446/153; 446/14; 446/385; 374/141; 473/594

(58) Field of Search ..... 446/153, 183, 446/320, 369, 267, 385, 14; 374/141, 161, 162; 473/594, 570

(56) References Cited

U.S. PATENT DOCUMENTS

| | | | | |
|---|---|---|---|---|
| 3,382,607 A | | 5/1968 | Ryan et al. | |
| 3,980,300 A | | 9/1976 | Hornsby, Jr. | |
| 4,028,118 A | | 6/1977 | Nakasuji et al. | |
| 4,134,853 A | | 1/1979 | Ehrlich et al. | |
| 4,212,460 A | | 7/1980 | Kraft | |
| 4,421,560 A | | 12/1983 | Kito et al. | |
| 4,444,819 A | | 4/1984 | Maruta et al. | |
| 4,462,616 A | | 7/1984 | Shanton | |
| 4,560,604 A | | 12/1985 | Shimizu et al. | |
| 4,567,019 A | | 1/1986 | Lawton | |
| 4,611,072 A | | 9/1986 | Nachbar et al. | |
| 4,637,616 A | | 1/1987 | Whiting | |
| 4,720,301 A | | 1/1988 | Kito et al. | |
| 4,826,550 A | * | 5/1989 | Shimizu et al. | 156/166 |
| 4,830,370 A | | 5/1989 | Schlesinger | |
| 4,890,838 A | | 1/1990 | Rudell et al. | |
| 4,991,847 A | | 2/1991 | Rudell et al. | |
| 5,011,445 A | * | 4/1991 | Nakasuji et al. | 446/14 |
| 5,026,054 A | | 6/1991 | Osher et al. | |
| 5,288,256 A | | 2/1994 | Lee et al. | |
| 5,389,093 A | * | 2/1995 | Howell | 604/361 |
| 5,503,583 A | * | 4/1996 | Hippely et al. | 446/14 |
| 5,746,639 A | * | 5/1998 | Bloom et al. | 446/98 |
| 6,024,661 A | * | 2/2000 | Guenther et al. | 473/605 |
| 6,139,395 A | | 10/2000 | Liao | |
| 6,346,024 B1 | * | 2/2002 | Engel | 446/14 |
| 6,468,088 B1 | * | 10/2002 | Fujita et al. | 434/295 |

FOREIGN PATENT DOCUMENTS

| | | |
|---|---|---|
| GB | 2066089 | 7/1981 |

* cited by examiner

*Primary Examiner*—Derris H. Banks
*Assistant Examiner*—Jamila Williams
(74) *Attorney, Agent, or Firm*—Patterson, Thuente, Skaar & Christensen, P.A.

(57) ABSTRACT

A color changing water toy generally includes a porous absorbent core that absorbs water, typically made from a soft open cell foam. The porous core is covered with colorful graphics, at least some of which are printed with thermochromically sensitive paint or dye. The absorbent core is preferably covered with a porous skin typically made with fabric that has been printed with the colorful graphics. At least some of the graphics are printed with thermochromically sensitive paint or dye. Thus, the color changing water toy absorbs water that is readily released upon the water toy striking an object and also changes color depending upon the temperature of its environment.

15 Claims, 3 Drawing Sheets

TEMPERATURE SENSITIVE COLOR CHANGING WATER TOY

FIELD OF THE INVENTION

The present invention relates to thermochromically sensitive toys, more particularly, the invention relates to an absorbent sponge toy having a fabric cover treated with temperature sensitive paint that appears differently colored depending upon the temperature to which the toy is exposed.

BACKGROUND OF THE INVENTION

Porous absorbent sponge toys exist in the toy makers' art. They are typically exposed to water and then tossed at persons or objects to splash water on the person or object.

In the past, a variety of toys have been developed with color-changing features using thermochromic or light-sensitive materials embedded or mixed in plastic, printed on paper or plastic, or impregnated in fibers used for clothing, doll hair, plush figures, or the like. For example, U.S. Pat. No. 4,560,604 issued to Shimizu et al., on Dec. 24, 1985 (coating fibers used for stuffed toys with thermochromic material); U.S. Pat. No. 4,134,853 issued to Ehrlich et al. on Jan. 16, 1979 (photochromic composition combined with moldable materials for forming toys); and U.S. Pat. No. 3,980,300 issued to Hornsby, Jr. on Sep. 14, 1976 (layer of liquid crystalline material used for ball) which disclose the use of such materials in toys. British Patent No. GB 2,066,089A issued to Rickson on Jul. 8, 1981, describes the use of temperature-sensitive cholesteric liquid crystal material for changing the color of the eyes of a doll. U.S. Pat. No. 3,382,607 issued to Ryan et al. on May 14, 1968 discloses a figure toy having synthetic hair fibers impregnated with an indicator dye which changes color in response to contact with liquids of different pH concentrations.

Thermochromic materials are disclosed in U.S. Pat. No. 4,567,019 issued to Lawton on Jan. 28, 1986; U.S. Pat. No. 4,421,560 issued to Kito et al. on Dec. 20, 1983; and U.S. Pat. No. 4,028,118 issued to Nakasuji et al. on Jun. 7, 1977. Heat-sensitive recording materials are described in U.S. Pat. No. 4,611,072 issued to Nachbar et al.; U.S. Pat. No. 4,462,616 issued to Shanton on Jul. 31, 1984; and U.S. Pat. No. 4,444,819 issued to Maruta et al. A reversible heat sensitive recording composition is disclosed in U.S. Pat. No. 4,720,301 issued to Kito et al. on Jan. 19, 1988.

None of the above-referenced patents discloses or suggests the use of a thermochromic material with an absorbent sponge toy.

SUMMARY OF THE INVENTION

The present invention provides an absorbent, porous soft toy that changes color as the temperature of the toy varies. The toy of the present invention generally includes a porous absorbent core that absorbs water, typically made from a soft open cell foam. The absorbent core is covered with a porous skin typically made with fabric that has been printed with colorful graphics. At least some of the graphics are printed with thermochromically sensitive paint or dye. Thus, the color changing water toy will absorb water that is readily released upon the water toy striking an object and also changes color depending upon the temperature of its environment.

A porous absorbent water toy covered with thermochromic material provides numerous play opportunities. For example, a child can immerse the toy in water at different temperatures and observe the toy changing from one color to another as it is moved from one temperature water to another. The color of the toy also changes with exposure to different air temperatures. The toy is typically used in play by immersing it in water and then throwing it at an object. Most of us have tossed water balloons at some time in our lives. The advantage of the present toy over water balloons is that it is readily reusable and also does not create an environmental hazard in the form of small pieces of plastic that can be ingested by animals or small children.

Further play opportunity is that depending upon temperature of the water in which the toy is soaked before throwing, the recipient of the splash would be forewarned as to whether to expect a splash of water that is warm or cold. Accordingly, there is a need in the toy manufacturing arts for a toy that can be soaked with water and changes color based on the temperature of its environment.

DETAILED DESCRIPTION OF THE INVENTION

Figure 1:
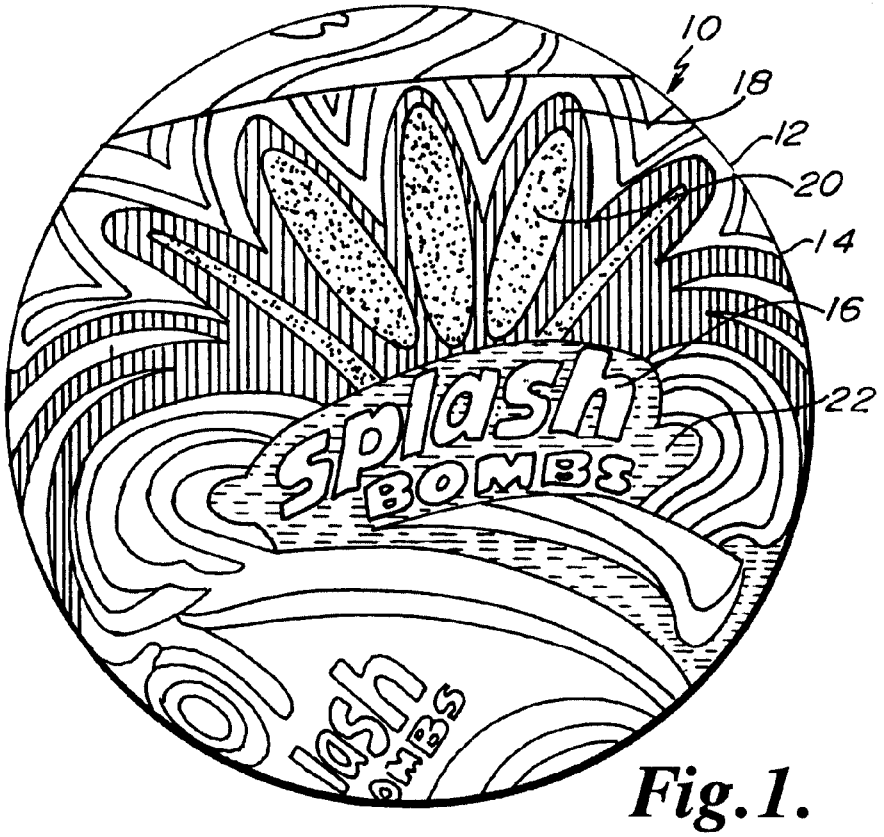
FIG. 1 is a perspective view of a first embodiment of the color changing water toy in accordance with the present invention having portions thereof covered with a thermochromic material.

The color changing water toy 10 of the present invention generally includes a soft porous absorbent core 11 and a water permeable exterior shell 12. The water permeable shell 12 is preferably made of a durable porous synthetic fabric 14. Preferably, fabric 14 is printed with colorful graphics 16. In another alternate embodiment, the graphics may be applied to the soft porous absorbent core 11 and covered by a mesh, translucent or transparent shell 12. Preferably, graphics 16 are printed on the water permeable exterior hell 12. Graphic 16 may include any number of colors. Preferably, graphic 16 includes three or four colors.

Water permeable exterior shell 12 may be formed of any material that will allow liquid to pass through with sufficient facility. Materials may include fabric, mesh, perforated plastic or other perforated sheet material.

Referring to FIG. 1, a first embodiment of the invention includes first color 18, second color 20 and third color 22. For example, first color 18 may be purple, second color 20 may be yellow and third color 22 may be green when the color changing water toy 10 is at room temperature.

Figure 2:
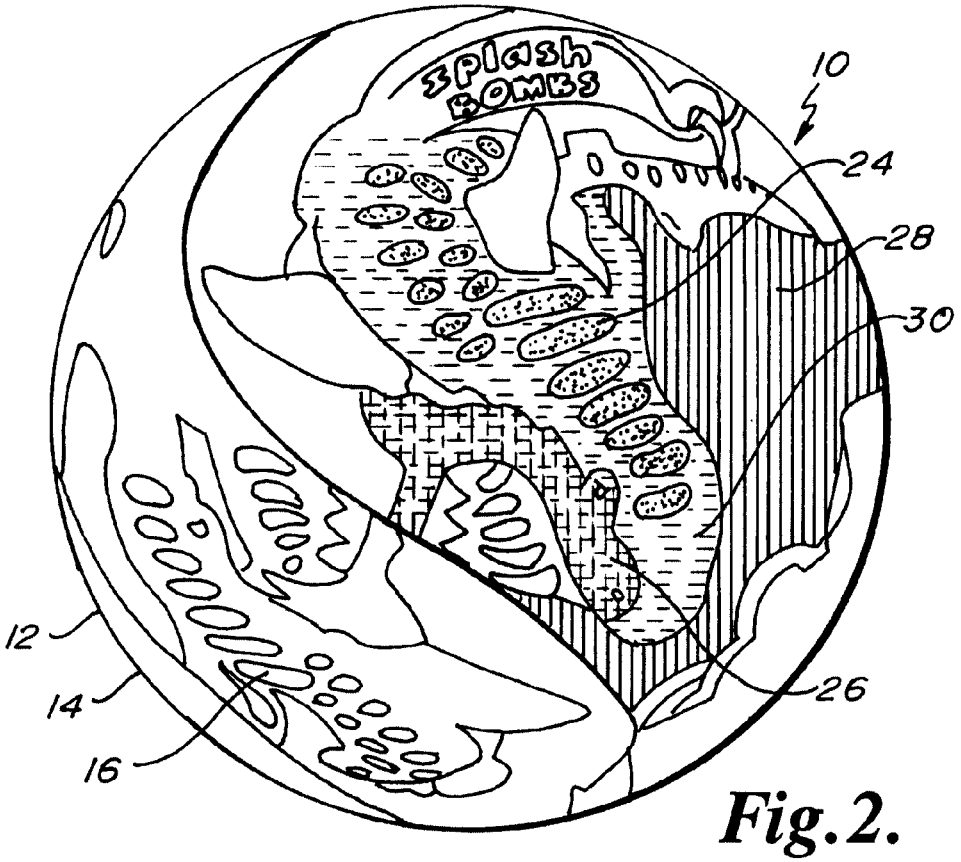
FIG. 2 is a perspective view of a second embodiment of the color changing water toy.

Referring to FIG. 2, in a second exemplary embodiment, graphic 16 may include four colors. In this embodiment of the invention, first color 24 may be blue, second color 26 may be green, third color 28 may be orange and fourth color 30 may be yellow. This color scheme applies when the color changing water toy 10 is below, for example, 27° C. Above that temperature, one or more colors would change.

Figure 3:
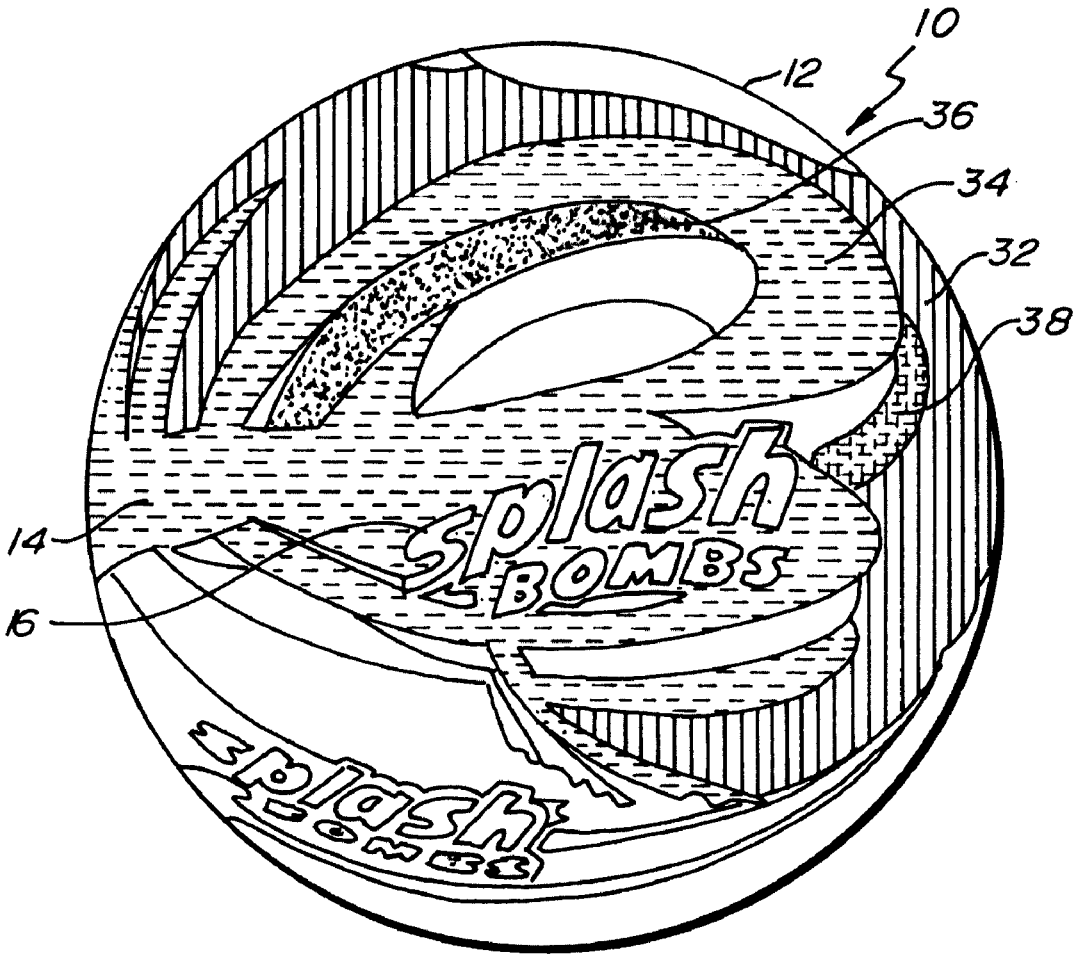
FIG. 3 is a perspective view of a third embodiment of the color changing water toy.

Referring to FIG. 3, the third embodiment of the invention may also include four colors. In this embodiment, the first color 32 may be purple, the second color 34 may be orange, the third color 36 may be yellow, and the fourth color 38 may be green when the color changing water toy is below, for example, 27° C.

In any embodiment of the color changing water toy 10, one or more of the three or four colors may be applied to the fabric with a thermochromic paint or dye. One preferable method for applying the thermochromic paint or dye is that of screen printing.

Thus, in operation, when the color changing water toy is in an environment below a chosen temperature, one or more of the colors on the color changing water toy is a first color. For example, a portion of the color changing water toy may be purple below 27° C. but when immersed in water above 27° C. or exposed to air above 27° C. would change to pink. Generally, it is envisioned that the color change would occur within a temperature range of 20° C. to 30° C. The temperature of 27° C. as well as the colors described are exemplary and are not intended to limit the scope of the invention.

To manufacture the color changing water toy 10, a sheet of open cell foam or sponge is initially cut into cubes or another desired shape. If desired, the cubes may be lathed into spheres or another desired shape.

Figure 5:
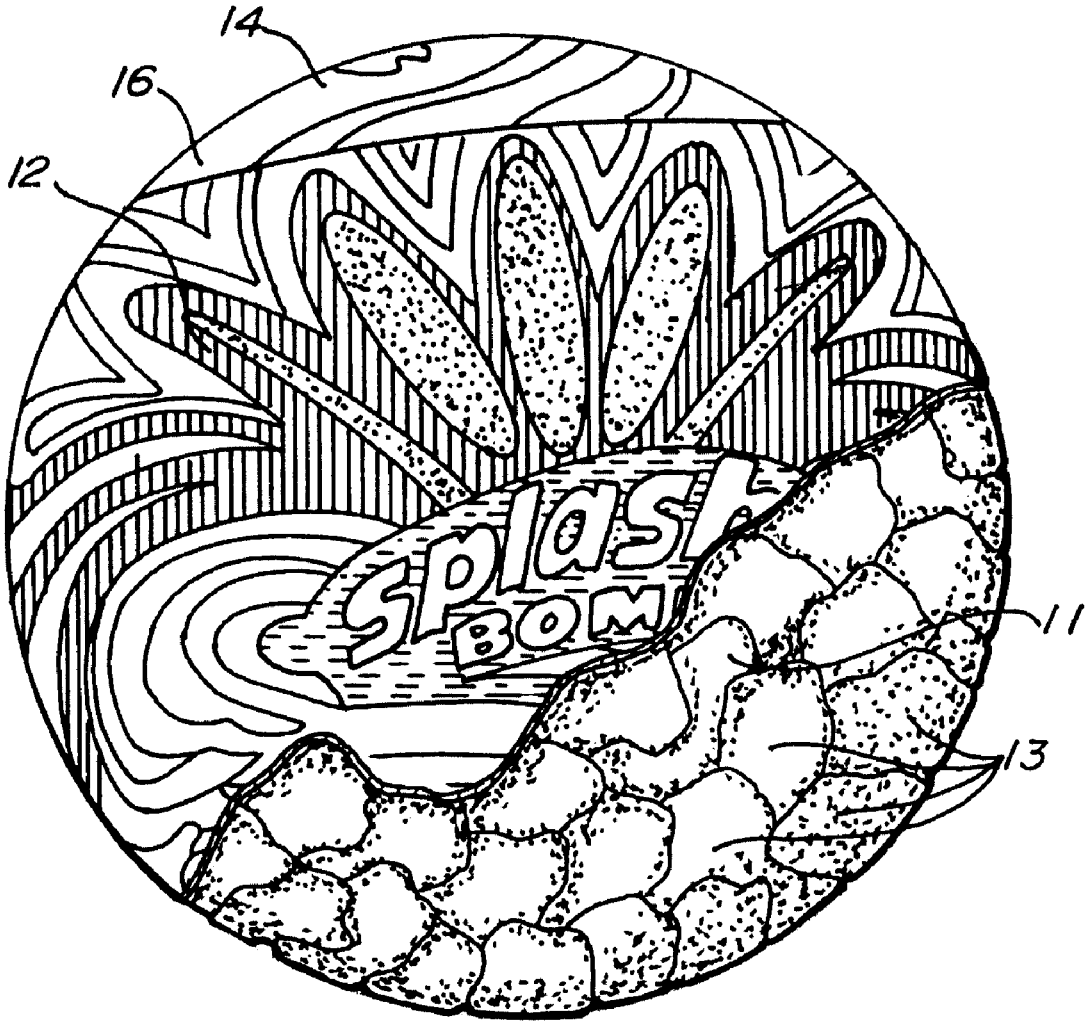
FIG. 5 is a cut-away view of an alternate embodiment of the color changing water toy.

Referring to FIG. 5, alternatively, the soft porous absorbent core 11 may be built up from a plurality of smaller pieces 13 of absorbent material. These may be many loose pieces of material enclosed within a single water permeable exterior shell 12 or the smaller pieces of material may be bound together. For example, a plurality of rod shaped portions of soft porous absorbent material may be joined together at their centers by, for example, a staple or cord. The compression of the rods at their centers causes the ends of the rods to radiate from a central location thus forming an appropriate ball shaped structure.

Figure 4:
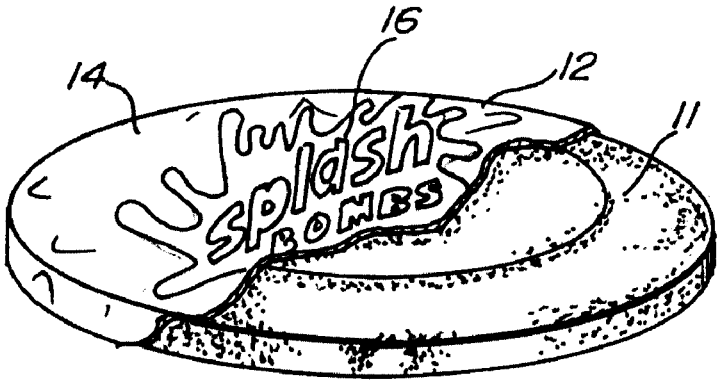
FIG. 4 is a cut-away view of a disk shaped embodiment of the color changing water toy.

As depicted in FIG. 4, the soft porous absorbent core may be made in any other desired shape. For example, the core may be shaped as a spheroid, a cube, a football, a disk, an annulus, or a boomerang.

Alternate soft porous absorbent materials include fabric, cotton, cellulose fibers, synthetic fibers and any combination thereof Fabric or other porous skin material to form the water permeable cover 12 is printed with thermochromic colored material. Thermochromic materials suitable for imprinting on fabric 12 are disclosed in U.S. Pat. No. 4,567,019 issued to Lawton on Jan. 28, 1986; U.S. Pat. No. 4,421,560 issued to Kito et al., on Dec. 20, 1983; and U.S. Pat. No. 4,028,118 issued to Nakasuji et al., on Jun. 7, 1977. These patents are hereby incorporated in their entirety by reference. Screen printing or any other pattern making process may be used. The fabric is then cut into the desired shape for covering the foam core. The cut fabric is then stitched into shape while leaving a small portion of the stitching incomplete. Fusing or other joining techniques may be employed instead of stitching. Thereafter, the foam core is compressed and inserted into the water permeable cover 12 and the stitching of the water permeable cover is completed to entirely enclose the foam core 11.

In operation the color changing water toy may be immersed in water and squeezed and released to allow it to absorb water. It may then be tossed at any object. Upon striking another object the water is released creating a splash.

The present invention may be embodied in other specific forms without departing from the spirit of any of the essential attributes thereof, therefore, the illustrated embodiments should be considered in all respects as illustrative and not restrictive reference being made to the appended claims rather than to the foregoing description to indicate the scope of the invention.

What is claimed:

1. A method for manufacturing a temperature sensitive color changing water toy, comprising the steps of:

forming a soft porous liquid absorbent core;

printing a thin flexible outer shell material wit thermochromic material in a graphical pattern;

cutting said outer shell material to a desired shape to cover said core:

interconnecting the edges of said outer shell material into a covering to cover said core while leaving a non-interconnected opening in said outer shell material;

compressing said core;

inserting said core into said covering through said opening; and interconnecting the edges of said opening to complete said covering.

2. A temperature sensitive color changing water toy, comprising:

means for absorbing and releasably retaining a quantity of liquid;

means for changing the color of a surface of said toy in response to environmental temperature; and means for substantially enclosing said liquid absorbing and releasing means such that liquid may be absorbed and released by said absorbing and releasing means through said enclosing means.

3. The toy as claimed in claim 2, in which said means for changing the color of a surface of said toy in response to environmental temperature changes from one color to another color at a temperature within a range of 20° C. to 30° C.

4. The toy as claimed in claim 2, in which said toy is a shape selected from the group a consisting of a spheroid, a cube, a football, a disk, an annulus and a boomerang.

5. The toy as claimed in claim 3, in which said means for changing the color of a surface of said toy in response to environmental temperature changes from one color to another color at a temperature of about 27° C.

6. A temperature sensitive color changing water toy comprising:

a toy core, wherein said toy core functions to absorb and releasably retain a quantity of liquid;

a porous outer toy shell, wherein said toy shell substantially encloses said toy core such that said liquid may be absorbed and released by said toy core through said outer toy shell; and a color changing material, wherein said color changing material functions to change the color of a surface of said outer toy shell in response to an environmental temperature.

7. The toy as in claim 6, wherein said toy core comprises a material selected from the group consisting of open cell foam, sponge material, fabric, cotton, cellulose fibers, synthetic fibers and any combination thereof.

8. The toy as in claim 6, wherein said outer toy shell comprises a material selected from the group consisting of fabric, synthetic fiber fabric, fabric impregnated with thermochromatically sensitive material, mesh fabric and any combination thereof.

9. The toy as in claim 6, wherein said color changing material is applied to said outer shell by a process selected from the group consisting of screen printing and dyeing.

10. The toy as in claim 6, wherein said color changing material is a thermochromic paint.

11. The toy as in claim 6, wherein said color changing material changes from one color to another color at a temperature within a range of 20° C. to 30° C.

12. The toy as in claim 11, wherein said color changing material paint changes from one color to another color at about 27° C.

13. The toy as in claim 6, wherein a plurality of different colors of color changing material are utilized.

14. The toy as in claim 6, wherein said toy core comprises material selected from the group consisting of a unitary piece of material, a plurality of separate pieces of material, a plurality of separate pieces of material that are operably interconnected to one another and any combination thereof.

15. The toy as in claim 6, wherein said outer toy shell comprises a shape selected from the group consisting of a spheroid, a cube, a football, a disk, an annulus and a boomerang.

* * * * *